US011498822B2

(12) United States Patent
Lucas

(10) Patent No.: US 11,498,822 B2
(45) Date of Patent: Nov. 15, 2022

(54) SCREW CAP TWISTING TOOL

(71) Applicant: Jeffrey Lucas, Hopkins, MN (US)

(72) Inventor: Jeffrey Lucas, Hopkins, MN (US)

( * ) Notice: Subject to any disclaimer, the term of this patent is extended or adjusted under 35 U.S.C. 154(b) by 348 days.

(21) Appl. No.: 16/924,070

(22) Filed: Jul. 8, 2020

(65) Prior Publication Data

US 2021/0009395 A1 Jan. 14, 2021

Related U.S. Application Data

(60) Provisional application No. 62/921,799, filed on Jul. 8, 2019.

(51) Int. Cl.

| | |
|---|---|
| ***B67B 7/44*** | (2006.01) |
| ***B67B 7/16*** | (2006.01) |
| ***B67B 7/18*** | (2006.01) |

(52) U.S. Cl.

CPC ..... *B67B 7/44* (2013.01); *B67B 7/16* (2013.01); *B67B 7/18* (2013.01)

(58) Field of Classification Search

CPC ..... B67B 7/16; B67B 7/18; B67B 7/44

See application file for complete search history.

(56) References Cited

U.S. PATENT DOCUMENTS

| | | | | |
|---|---|---|---|---|
| 2,651,957 | A * | 9/1953 | Phillips | B67B 7/162 81/3.43 |
| 3,343,432 | A * | 9/1967 | Nagy | B67B 7/18 81/3.42 |
| 7,367,248 | B2 * | 5/2008 | Ruffner | B67B 7/18 81/3.44 |
| 2008/0083302 | A1 * | 4/2008 | Hood | B67B 7/18 81/3.44 |
| 2015/0158709 | A1 * | 6/2015 | Muhlfelder | B67B 7/18 81/3.09 |
| 2019/0330036 | A1 * | 10/2019 | Graham | G01K 1/143 |

* cited by examiner

*Primary Examiner* — David B. Thomas

(57) ABSTRACT

A screw cap twisting tool uses two primary members—a stationary member with gripping surface(s) and a high-mechanical-advantage-for-gripping pivoting member with gripping surface(s)—to easily and effectively grip and twist a screw cap. The screw cap twisting tool is easily operated by pushing the screw cap against the pivoting member. A screw cap twisting tool also uses a method for holding the pivoting member in its most open position before screw cap insertion. This method for holding the pivoting member in its most open position can be accomplished in numerous ways by using a force opposing feature, member, or mechanism that allows movement and/or deformation when force is applied and restores position and/or shape when force is removed. Examples include, but are not limited to: built-in elastic metal or plastic material, separate metal or plastic spring, separate elastic O-ring or rubber band, gravity, or magnetism.

8 Claims, 9 Drawing Sheets

SCREW CAP TWISTING TOOL

CROSS-REFERENCE TO RELATED APPLICATIONS

This application claims the benefit of U.S. Provisional Application Ser. No. 62/921,799, titled "Screw Cap Twisting Tool," filed on Jul. 8, 2019. This application incorporates the entire contents of the foregoing application herein by reference.

FIELD OF THE INVENTION

The present disclosure relates generally to screw cap twisting tools. Specifically, the present disclosure relates to a screw cap twisting tool configured to use two primary members, including a stationary member with gripping surface(s) and a high-mechanical-advantage-for-gripping pivoting member with gripping surface(s), to easily and effectively grip and twist a screw cap.

BACKGROUND OF THE INVENTION

Because twist type bottle caps can be difficult to twist—especially for people who have reduced hand function caused by age, arthritis, accident, congenital disability, or the like—numerous devices have been developed to make the process easier. Although there have been numerous screw cap twisting tool patents filed and awarded, very few of these devices can be found in the marketplace. There are two main reasons for this: first, some devices do not provide enough mechanical advantage to make twisting significantly easier and second, some devices are cumbersome to operate—being difficult to manipulate, not easily gripping well, and/or wearing out too quickly. The goal of the present screw cap twisting tool invention is to provide both ease of use and high mechanical advantage for gripping. The two basic approaches to cap twisting tool operation appear to be either squeeze and twist or push and twist wherein the cap interfacing mechanism is primarily flexible or rigid. (Cap twisting tools that have elastic gripping materials on the surfaces of rigid parts would still be classified as primarily rigid.) When classified in this way, the prior art appears to fall into five main categories: flexible push, flexible squeeze, rigid-hinged squeeze, rigid-sliding squeeze, and conical push. The present invention falls into a unique rigid hinged push category wherein the tool is easy to operate—push and twist—and provides high mechanical advantage for gripping—rigid hinged with significant leverage. The prior art appears to emphasize only one of the two goals. Either it is easy to use but provides insufficient mechanical advantage for gripping, or it provides high mechanical advantage for gripping but is more difficult to operate. The present invention provides both ease of use and high mechanical advantage for gripping.

RELATED ART

DE29800091U1, EP2388230A1, GB1501774A, GB2084549A, GB2187720A, GB2275918A, JP2011057240A, JP2014234203A, JP5396384B2, U.S. Pat. Nos. 1,342,848A, 1,752,189A, 1,954,422A, 1,960,531A, 1,976,623A, 1,994,415A, US20050252343A1, US20070204726A1, US20080072709A1, US20090145267A1, US20110220607A1, US20130098210A1, US20140338499A1, US20170210607A1, U.S. Pat. Nos. 2,053,246A, 2,323, 621A, 2,422,715A, 2,519,447A, 2,589,693A, 2,641,943A, 2,673,481A, 2,761,337A, 2,761,337A, 2,810,311A, 2,880,633A, 2,929,283A, 2,985,046A, 3,048,068A, 3,143,904A, 3,247,742A, 3,604,290A, 3,730,025A, 3,812,741A, 3,919,901A, 4,179,954A, 4,235,132A, 4,262,560A, 4,337,678A, 4,414,865A, 4,474,087A, 4,507,988A, 4,509,784A, 4,702,129A, 4,723,465A, 4,768,403A, 4,979,407A, 5,388,297A, 5,893,301A, 6,263,761B1, 6,666,110B1, 7,051,621B1, 7,069,815B1, 7,240,589B2, 7,267,031B1, 9,187,305B1, USD277160S, USD548032S1, USD656803S1, WO1983002265A1, WO1986005473A1.

SUMMARY

The present invention, a screw cap twisting tool, makes it easier to twist screw caps. By inserting a screw cap into the screw cap receptacle area of the screw cap twisting tool, the gripping features of the tool automatically adjust to fit the most common sizes of screw caps used on beverage containers. A much shorter closing translation of a pivoting member compared to a much longer circumferential translation of the pivoting member creates a great mechanical advantage for tightly gripping a screw cap when pushing the screw cap against the pivoting member with significantly less force. This greatly improves an operator's ability to securely grip a screw cap. The screw cap twisting tool also has a radial distance from the twisting axis that is significantly greater than the screw cap itself, which reduces the rotational force needed to twist the screw cap. Providing a secure grip and great leverage by simply inserting with moderate force a screw cap into a screw cap receptacle area, the screw cap twisting tool makes it much easier to twist screw caps.

Specifically, the present invention includes a single article. This article is a screw cap twisting tool comprising two members and a position retaining method. One member is a stationary member having a feature that interfaces with a screw cap and has at least one surface within the cap interfacing feature for gripping a screw cap. The stationary member also has a hand interfacing feature that fits comfortably within the human hand and has a radius that is greater than the screw cap with which it interfaces so that more rotational force can be applied to twisting a screw cap.

The second member is a pivoting member that has a feature that interfaces with a screw cap and has at least one surface within the cap interfacing feature for gripping a screw cap. The pivoting member has a feature that accommodates a pivoting motion. The pivot point or rotational axis is positioned such that a larger amount of rotational translation results in a significantly smaller change in gap distance between the stationary member gripping surface and the pivoting member gripping surface, the mechanical advantage of which produces a stronger gripping force. The pivoting member is oriented such that pushing a screw cap against the pivoting member articulates the pivoting member in such a way that the distance between the stationary member gripping surface and the pivoting member gripping surface is reduced.

The position retaining method consists of any means for holding the pivoting member in its most open position before screw cap insertion. This method for holding the pivoting member in its most open position can be accomplished in numerous ways by using a force opposing feature, member, or mechanism that allows movement and/or deformation when force is applied and restores position and/or shape when force is removed. Examples include, but are not limited to: built-in elastic metal or plastic material, a separate metal or plastic spring, a separate elastic O-ring or rubber band, gravity, or magnetism.

This article combines simplicity with mechanical advantage to create a screw cap twisting tool with improved effectiveness and ease of use.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

This summary is provided merely for purposes of summarizing some example embodiments, so as to provide a basic understanding of some aspects of the subject matter described herein.

Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF DRAWINGS

Disclosed herein are embodiments of a vase assembly. This description includes drawings, wherein:

FIG. 2 also includes arrows that depict device movement and resulting positions of cap interfacing features. This preferred embodiment uses an elastic O-ring for holding the pivoting member in its most open position before screw cap insertion.

Figure 1:
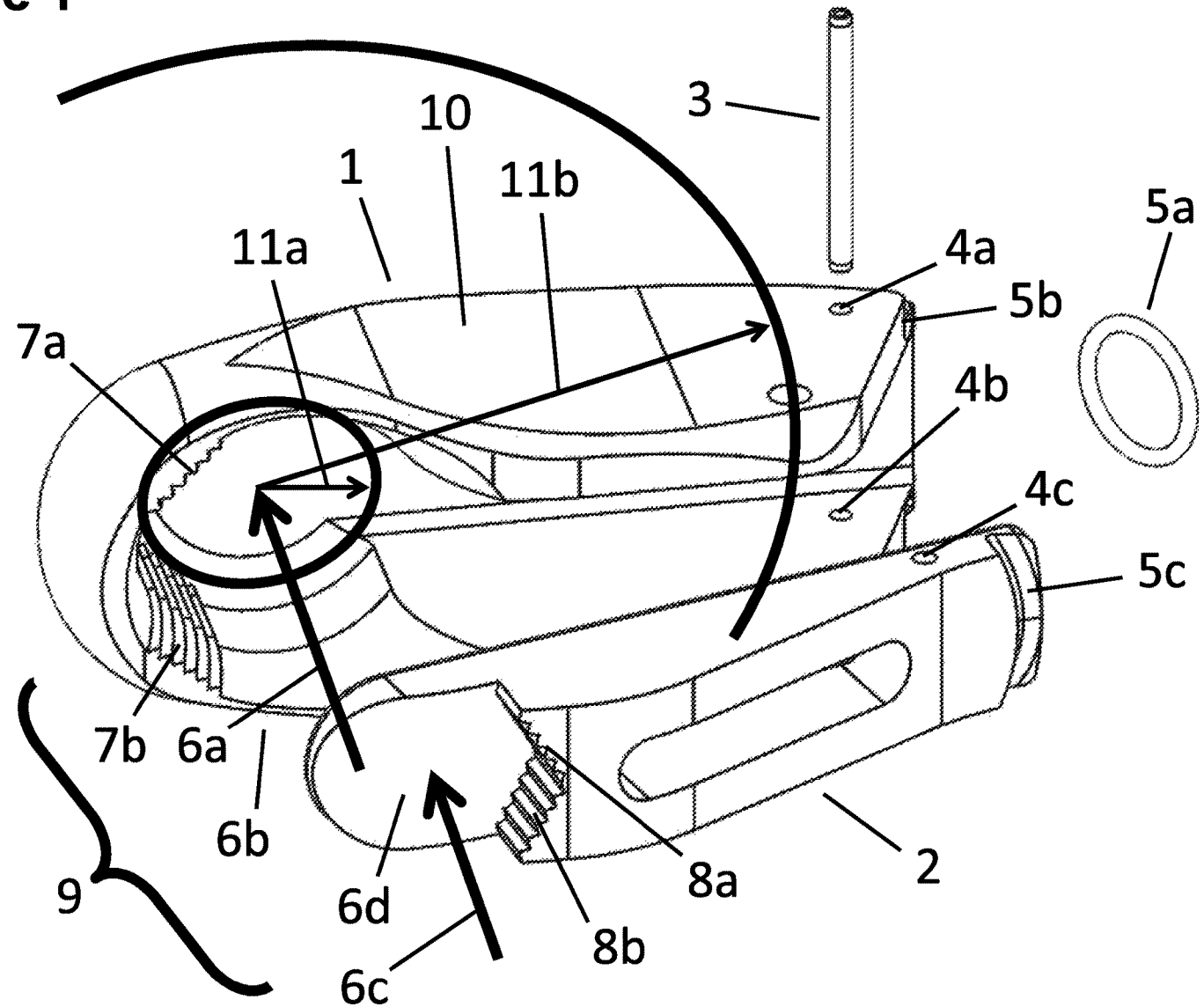
FIG. 1 shows a 3D exploded view of a preferred embodiment of a screw cap twisting tool. This view is oriented such that the screw cap twisting tool appears to be lying on its side to provide a clearer view of the cap receptacle area.

Elements in the figures are illustrated for simplicity and clarity and have not been drawn to scale. For example, the dimensions and/or relative positioning of some of the elements in the figures may be exaggerated relative to other elements to help to improve understanding of various embodiments of the present invention.

Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required.

The terms and expressions used herein have the ordinary technical meaning as is accorded to such terms and expressions by persons skilled in the technical field as set forth above except where different specific meanings have otherwise been set forth herein.

DETAILED DESCRIPTION

Some detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

The invention may be embodied in other specific forms without departing from the spirit of essential characteristics thereof.

The present embodiments therefore to be considered in all respects as illustrative and not restrictive, the scope of the invention being indicated by the appended claims rather than by the foregoing description, and all changes which come within the meaning and range of equivalency of the claims are therefore intended to be embraced therein.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The following description is not to be taken in a limiting sense, but is made merely for the purpose of describing the general principles of exemplary embodiments. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The present invention is a screw cap twisting tool that uses a pivoting member configured for high mechanical advantage to create strong cap gripping force and that is easily operated by pushing a screw cap into the tool's screw cap receptacle area and twisting.

FIG. 1 shows a 3D exploded view of a preferred embodiment of a screw cap twisting tool. An exterior surface of stationary member 1 provides a stationary member hand interfacing feature 10 that fits comfortably within the human hand. Pivoting member 2 fits inside stationary member 1 and is held in place with pivot pin 3. Pin capture holes 4*a* and 4*b* provide a press fit for pivot pin 3 so that pivot pin 3 does not slip out after insertion. Pin slip fit hole 4*c* provides a slip fit for pivot pin 3 so that pivoting member 2 can pivot about pivot pin 3 when pivoting member 2 is assembled within stationary member 1 and held in place with pivot pin 3. When installed on both stationary member 1 and pivoting member 2, position retaining elastic O-ring 5*a* is held in place by O-ring capture notches 5*b* and 5*c*. Position retaining elastic O-ring 5*a* serves as a position retaining method for holding pivoting member 2 in its most open position before screw cap insertion. Stationary member cap insertion arrow 6*a* shows the direction of screw cap insertion into stationary member cap interfacing feature 6*b*. Pivoting member cap insertion arrow 6*c* shows the direction of screw cap insertion into pivoting member cap interfacing feature 6*d*. Stationary member cap interfacing feature 6*b* together with pivoting member cap interfacing feature 6*d* form the complete cap receptacle area 9 of the screw cap twisting tool. Stationary member gripping surfaces 7*a* and 7*b* and pivoting member gripping surfaces 8*a* and 8*b* are within the cap receptacle area 9 of the screw cap twisting tool and provide additional friction for gripping and twisting a screw cap. Although the FIG. 1 preferred embodiment depicts the gripping surfaces within the cap receptacle area 9 as toothed or ribbed surfaces; other textures, materials having a high coefficient of friction, or some combination thereof may be used for improved gripping. The exterior surface of stationary member 1 forms a stationary member hand interfacing feature 10 that has a shape and surface quality that fits comfortably within the human hand. The stationary member hand interfacing feature 10 may or may not resemble what is depicted in the patent figures. The stationary member hand interfacing feature 10 can have any shape or texture that provides comfortable operation of the screw cap twisting tool. The stationary member hand interfacing feature 10 also has a radius that is greater than the screw cap with which it interfaces so as to provide greater leverage for twisting a screw cap. Screw cap radius arrow 11*a* depicts a smaller screw cap radius, while stationary member radius arrow 11*b* depicts a larger hand interfacing feature radius. The significantly larger radius depicted by stationary member radius arrow 11*b* compared to the significantly smaller radius depicted by screw cap radius arrow 11*a* illustrates the greater leverage provided by the screw cap twisting tool for twisting a screw cap about its axis of rotation.

Figure 2:
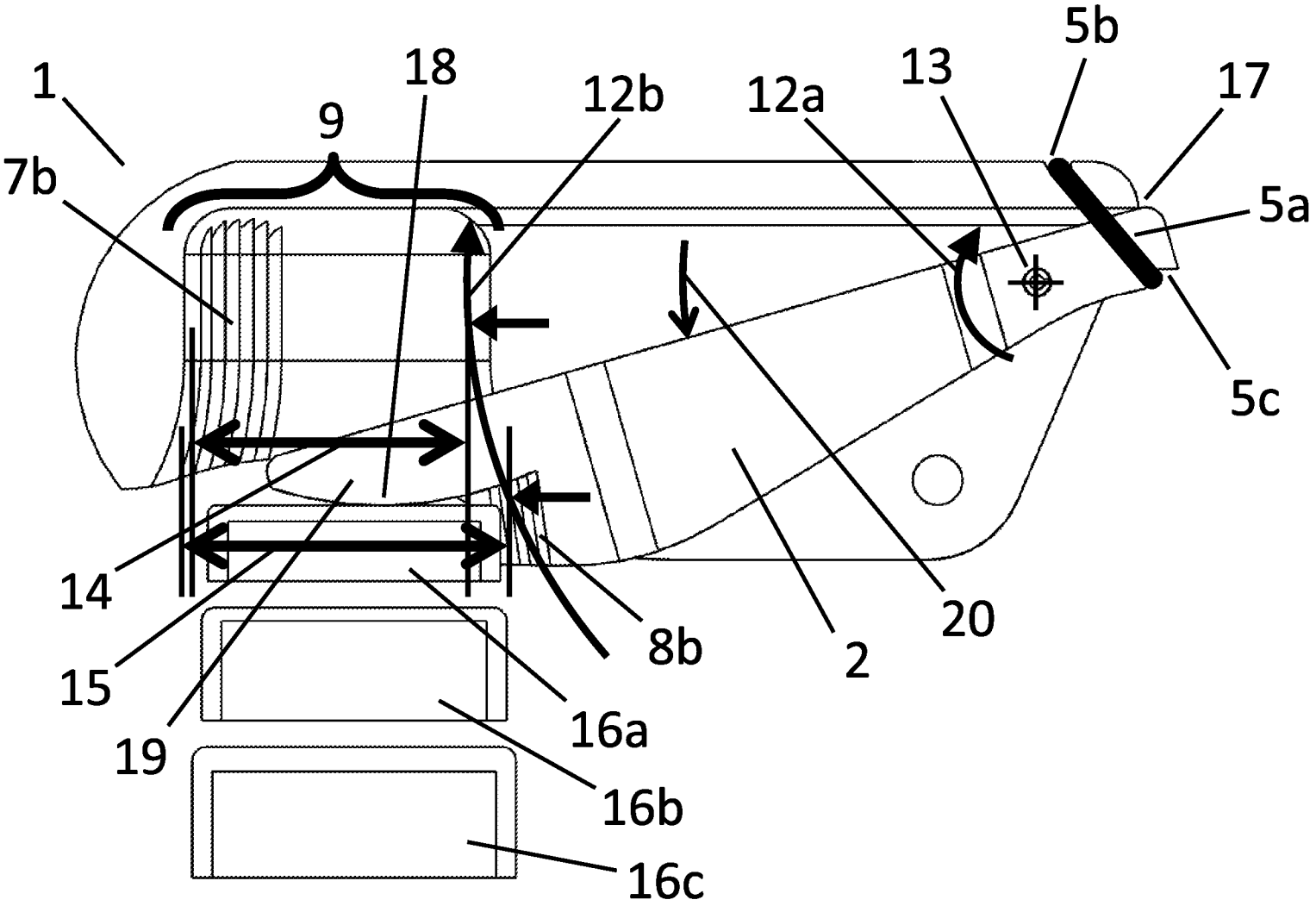
FIG. 2 shows a 2D illustration of a preferred embodiment of a screw cap twisting tool and some standard-sized bottle screw caps for scale reference.

FIG. 2 shows a 2D illustration of a preferred embodiment of a screw cap twisting tool and some standard-sized bottle screw caps for scale reference. FIG. 2 also includes arrows that depict device movement and resulting positions of cap interfacing features. Near pivot axis motion arrow 12*a* depicts the rotation of pivoting member 2 around pivot axis point 13. As shown in both FIG. 1 and FIG. 2, this preferred embodiment uses a position retaining elastic O-ring 5*a* for holding pivoting member 2 in its most open position before screw cap insertion, as depicted by position retaining arrow 20 in FIG. 2. The most open position of pivoting member 2 is when the left side of pivoting member 2 is down and the right side of pivoting member 2 is pulled up by position retaining O-ring 5*a* until the right side of pivoting member 2 is stopped by contact with stationary member 1 at pivot stop contact point 17. FIG. 2 shows pivoting member 2 rotated into its most open position. Stretched and fitted into O-ring capture notch 5*b* in stationary member land into O-ring capture notch 5*c* in pivoting member 2, O-ring 5*a* is held in place on the screw cap twisting tool. Three different sized screw caps for bottled beverages are illustrated in FIG. 2: a smallest standard screw cap 16*a*, a medium-sized screw cap 16*b*, and a largest standard screw cap 16*c*. The screw cap twisting tool can grip and twist any screw cap that ranges between a minimum and maximum height and that ranges between a minimum and maximum diameter. The design of a screw cap twisting tool can be varied for use with different minimum-maximum ranges of cap heights and diameters. When an appropriately sized screw cap is inserted into cap receptacle area 9 of the screw cap twisting tool, the screw cap makes contact with pivoting member 2 at pivot push contact point 18. FIG. 2 shows pivot push contact point 18 as the point where smallest standard screw cap 16*a* contacts pivot drive lip 19 of pivoting member 2. As smallest standard screw cap 16*a* is pushed further into cap receptacle area 9, pivoting member 2 pivots about pivot axis point 13. Far pivot axis motion arrow 12*b* depicts how the curved trajectory of pivoting member 2 reduces the distance between stationary member gripping surface 7*b* and pivoting member gripping surface 8*b*. Most closed arrow 14 depicts the smallest gap size of cap receptacle area 9, and most open arrow 15 depicts the largest gap size of cap receptacle area 9. The relatively small change in gap size from most open arrow 15 to most closed arrow 14 compared to the relatively large rotational movement of pivoting member 2 depicted by far pivot axis motion arrow 12*b* illustrates the high leverage/mechanical advantage created by the pivot accommodating feature of the screw cap twisting tool.

Figure 3:
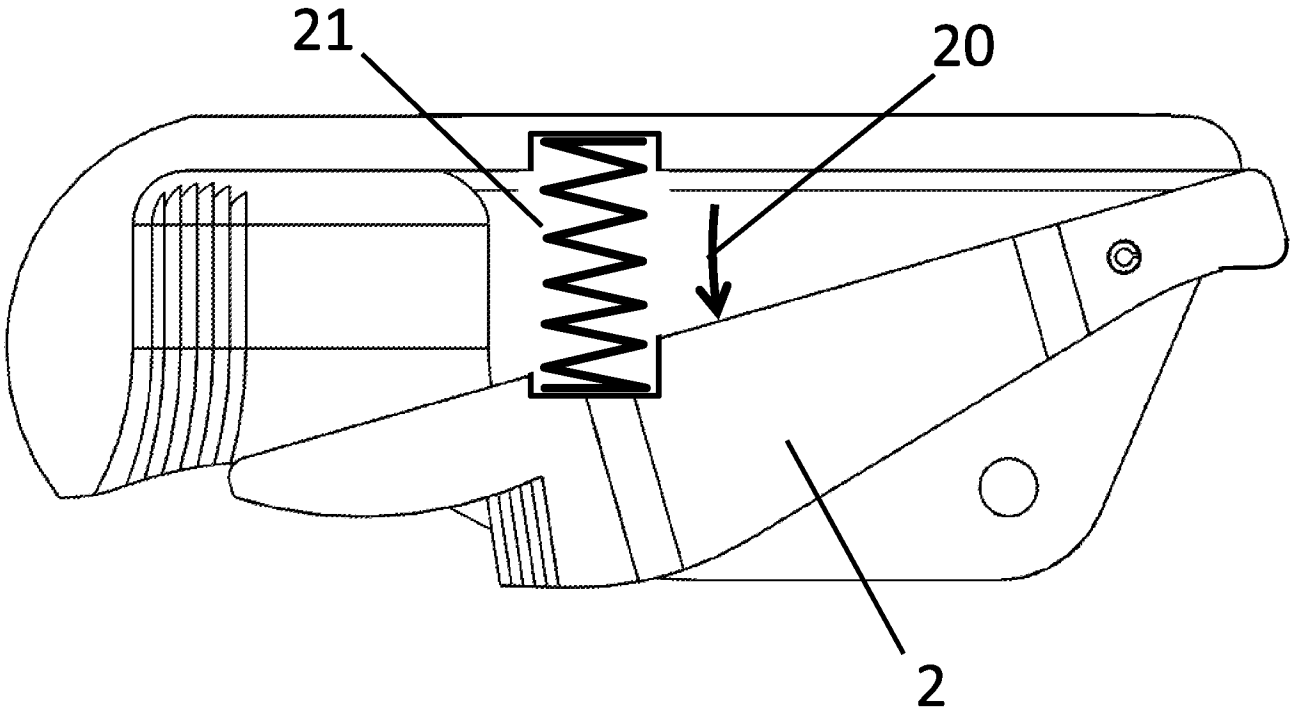
FIG. 3 shows a 2D illustration of a screw cap twisting tool that uses a spring for holding the pivoting member in its most open position before screw cap insertion.

FIG. 3 shows a 2D illustration of a screw cap twisting tool that uses a compression spring 21 for holding pivoting member 2 in its most open position before screw cap insertion, as depicted by position retaining arrow 20.

Figure 4:
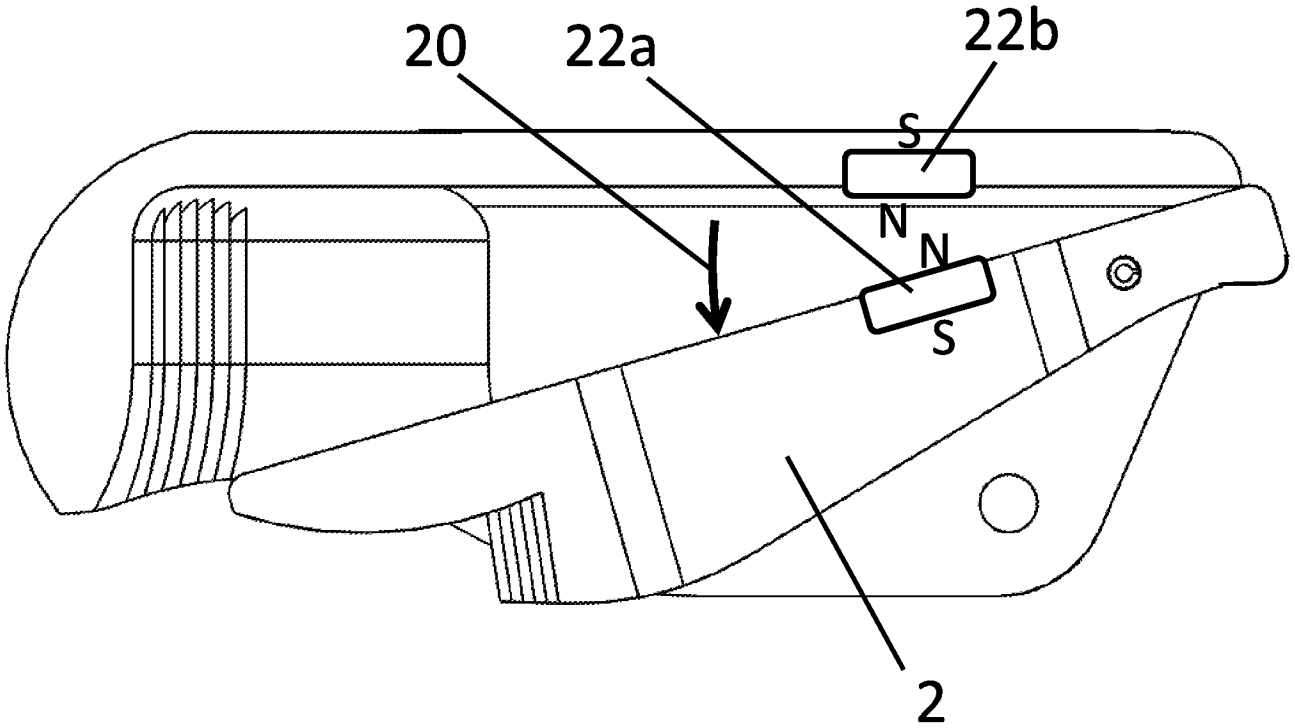
FIG. 4 shows a 2D illustration of a screw cap twisting tool that uses magnetic repulsion for holding the pivoting member in its most open position before screw cap insertion.

FIG. 4 shows a 2D illustration of a screw cap twisting tool that uses magnetic repulsion for holding pivoting member 2 in its most open position before screw cap insertion. Having one pole of magnet 22*a* facing the same pole of magnet 22*b*—for example north facing north—creates a magnetic repulsion that pushes pivoting member 2 into its most open position, as depicted by position retaining arrow 20.

Figure 5:
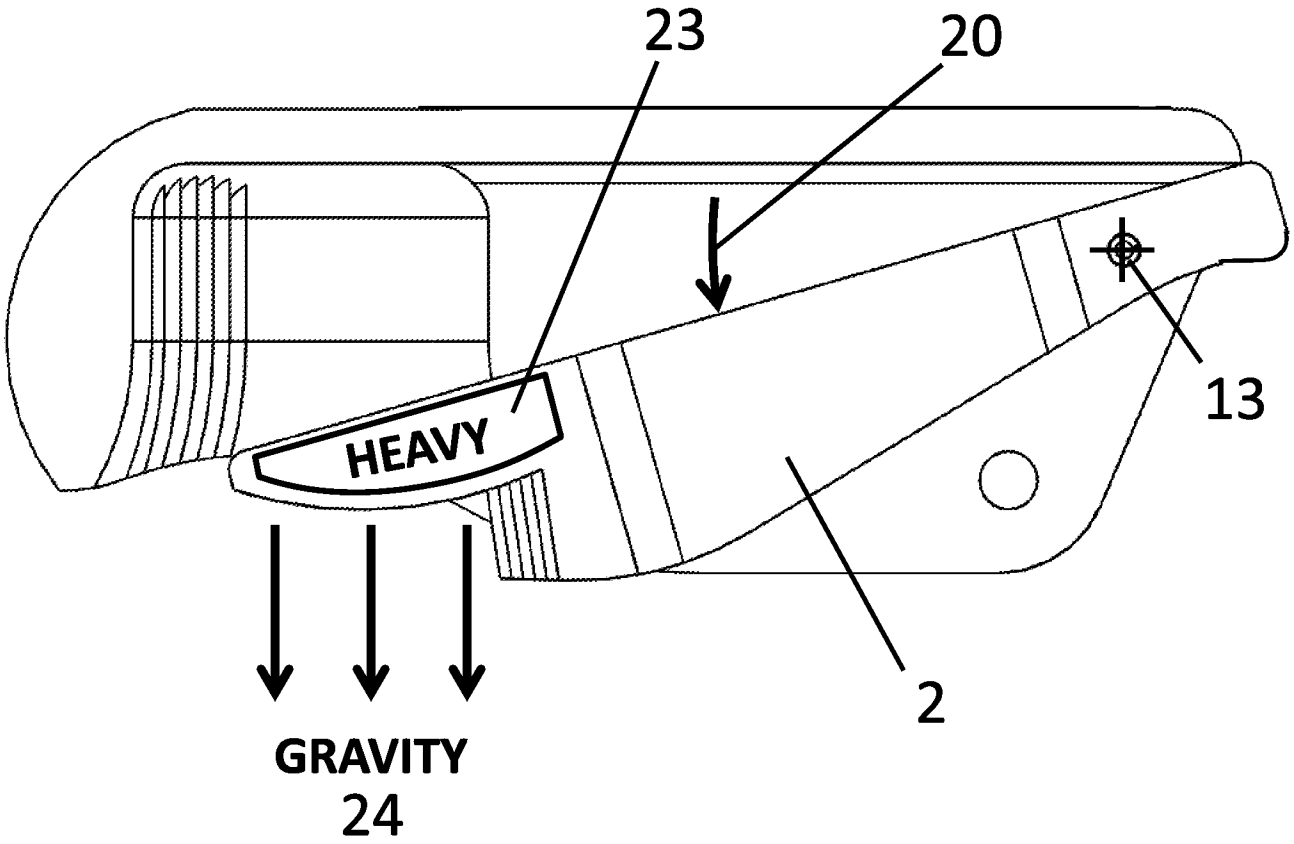
FIG. 5 shows a 2D illustration of a screw cap twisting tool that uses gravity for holding the pivoting member in its most open position before screw cap insertion.

FIG. 5 shows a 2D illustration of a screw cap twisting tool that uses gravity for holding pivoting member 2 in its most open position before screw cap insertion. Having an element of substantial weight 23 at a significant distance from pivot axis point 13 creates a gravitational pull 24 on pivoting member 2 when the screw cap twisting tool is oriented as shown relative to the earth's gravitational pull. This pulls pivoting member 2 into its most open position, as depicted by position retaining arrow 20.

Figure 6:
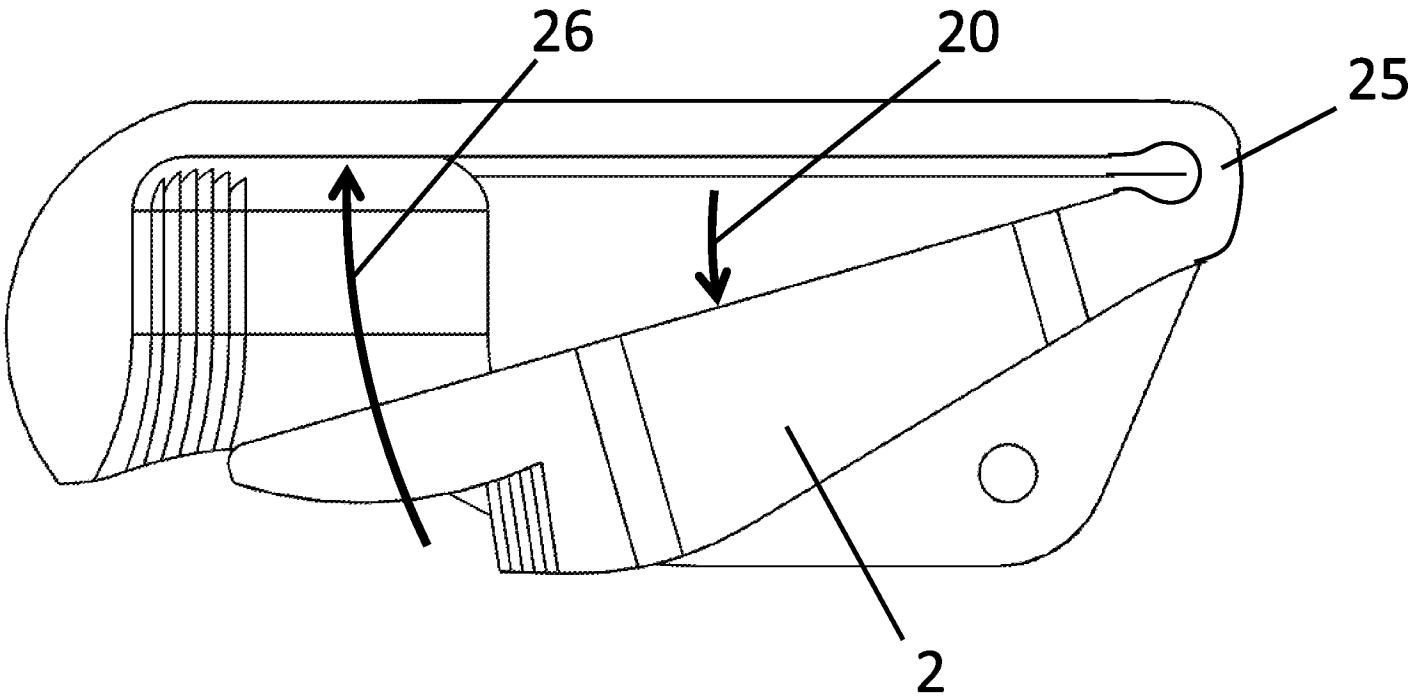
FIG. 6 shows a 2D illustration of a screw cap twisting tool that uses built-in elastic metal or plastic material for holding the pivoting member in its most open position before screw cap insertion.

FIG. 6 shows a 2D illustration of a screw cap twisting tool that uses built-in elastic metal or plastic material for holding pivoting member 2 in its most open position before screw cap insertion. Because of its shape retention properties, built-in elastic material feature 25 flexes when force is applied to pivoting member 2 to allow pivoting member 2 to rotate as depicted by flex pivot arrow 26 and it restores pivoting member 2 to its most open position, as depicted by position retaining arrow 20, when no force is being applied to pivoting member 2.

Figure 7A:
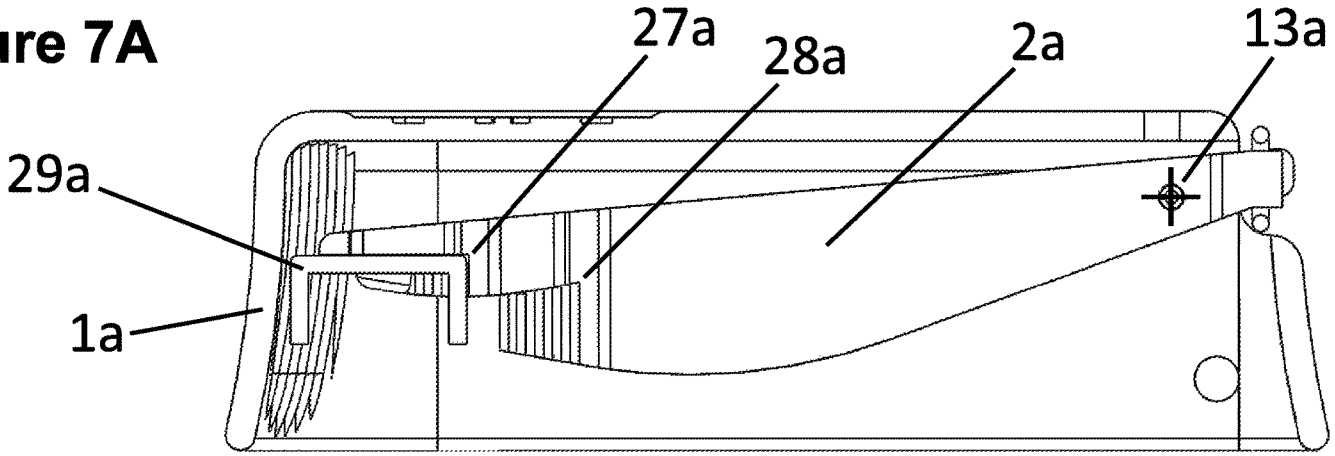
FIG. 7A shows a 2D illustration and FIG. 7B shows a 3D illustration of a screw cap twisting tool that has two different tiers to interface with screw caps having significantly different diameters.
Figure 7B:
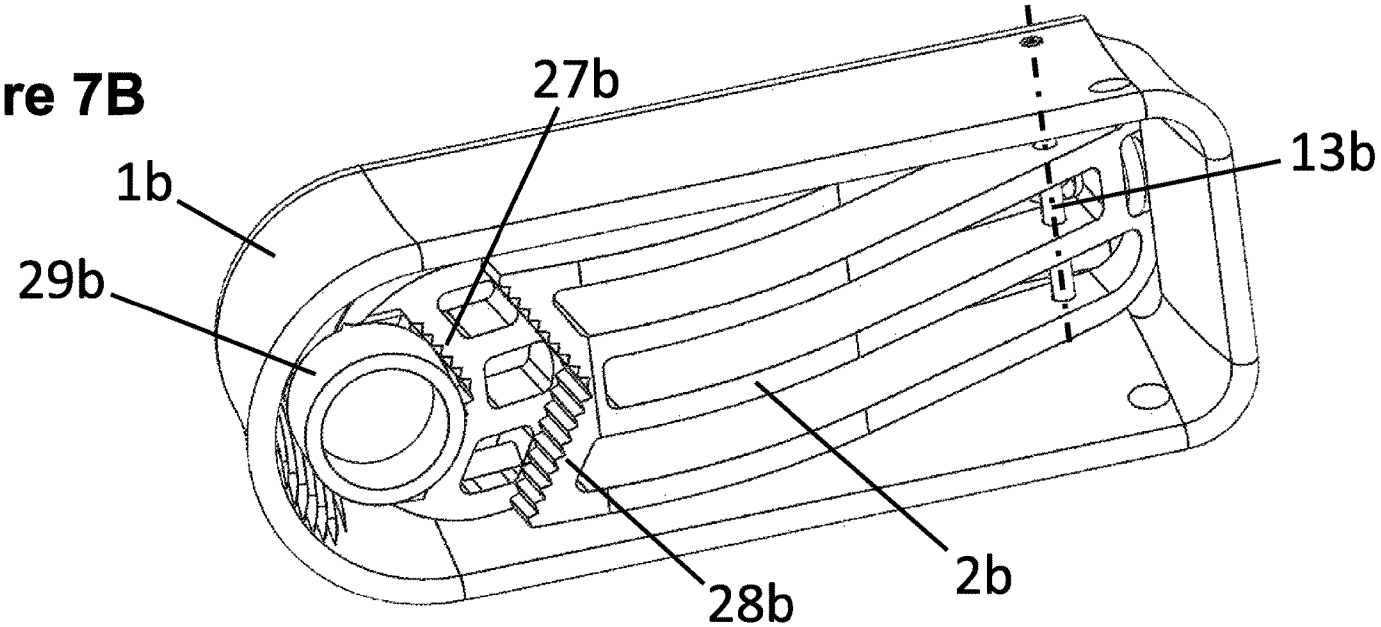

FIG. 7A shows a 2D illustration and FIG. 7B shows a 3D illustration of a screw cap twisting tool that has two different cap clamping tiers to interface with screw caps having significantly different diameters. Small cap clamping tier 27*a* of FIG. 7A and 27*b* of FIG. 7B forms a smaller clamping area between a toothed surface on the inside of stationary member 1*a* and 1*b* and a toothed surface that is farthest away from pivot axis 13*a* and 13*b* on pivoting member 2*a* and 2*b*. This clamping area is smaller so as to accommodate smaller "mini" bottle cap sizes depicted as 29*a* and 29*b*. Large cap clamping tier 28*a* of FIG. 7A and 28*b* of FIG. 7B creates a larger clamping area between the toothed surface on the inside of stationary member 1*a* and 1*b* and the toothed surface that is closest to pivot axis point 13*a* and 13*b* on pivoting member 2*a* and 2*b*. This clamping area is larger so as to accommodate larger bottle cap sizes.

Figure 8B:
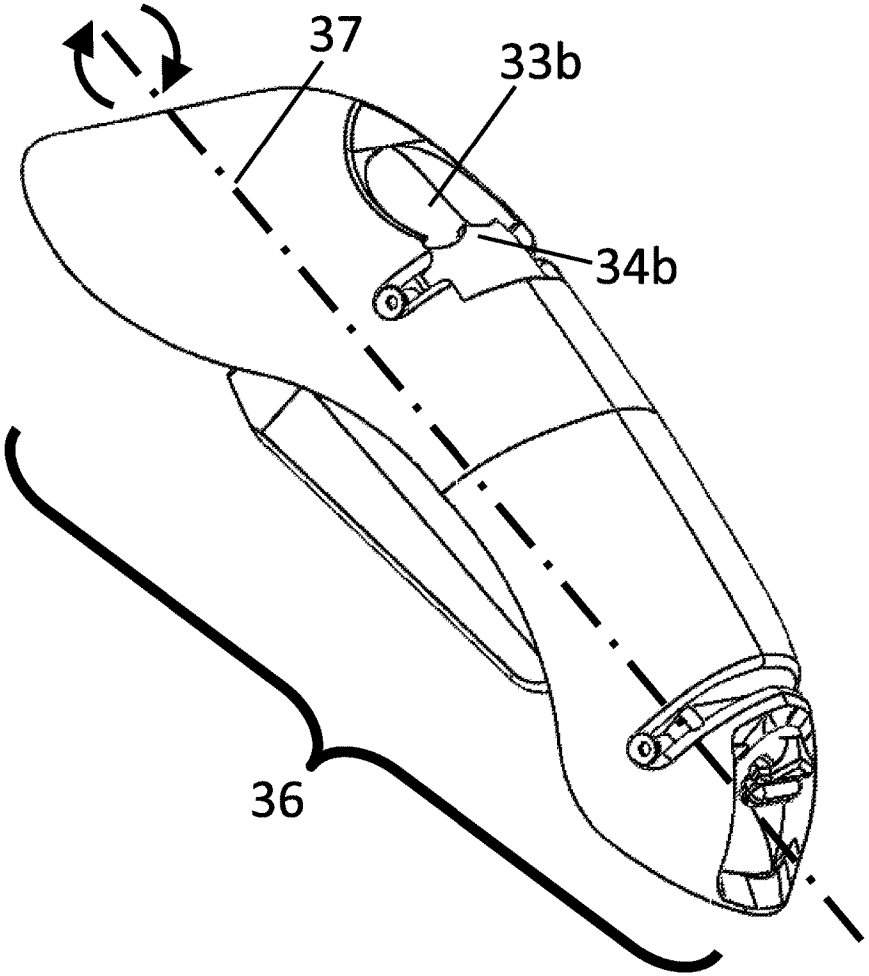
FIG. 8B shows a 3D illustration of a screw cap twisting tool that includes a flip cap catching feature for removal of caps that are press fit onto a beverage container.
Figure 8A:
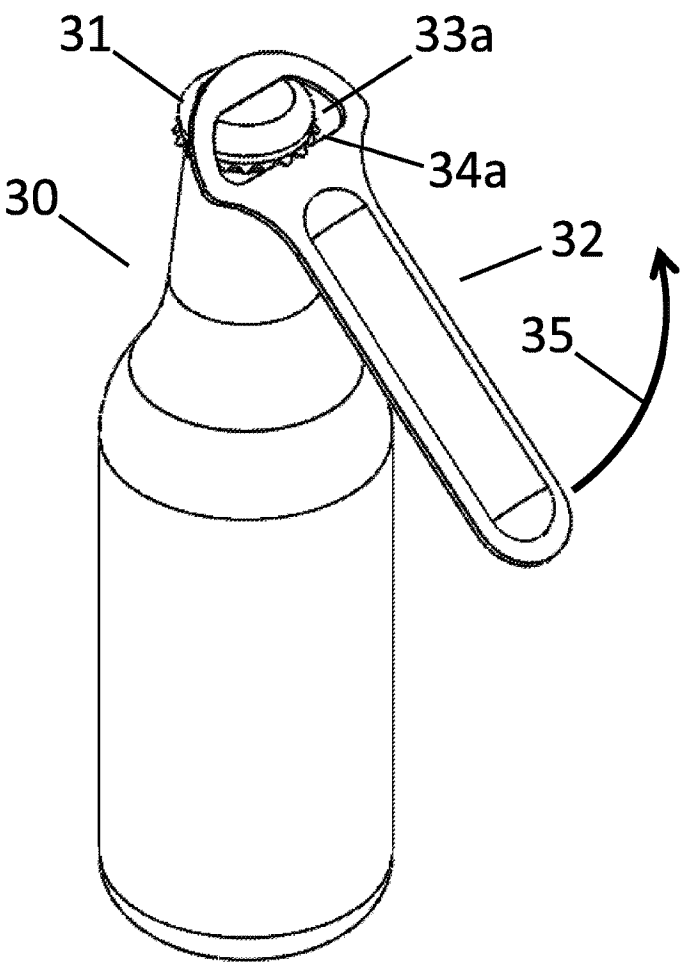
FIG. 8A shows a 3D illustration of a conventional flip cap opener for removal of caps that are press fit onto a beverage container and a beverage container with a press fit cap.

FIG. 8A shows a 3D illustration of a conventional flip cap opener for removal of caps that are press fit onto a beverage container such that cap removal requires prying rather than twisting. FIG. 8B shows a 3D illustration of a screw cap twisting tool that includes a flip cap catching feature for removal of caps that are press fit onto a beverage container such that cap removal requires prying rather than twisting. Flip cap 31 of FIG. 8A is press fit onto beverage container 30. A conventional flip cap opener 32 is shown in a position for prying off flip cap 31 with flip cap 31 partially extending through opening 33*a* in conventional flip cap opener 32 and flip cap catching feature 34*a* catching the bottom edge of flip cap 31. In this position, flip cap 31 can be removed by articulating conventional flip cap opener 32 as depicted by arrow 35. Screw cap twisting tool 36 of FIG. 8B can likewise remove flip caps like flip cap 31 by inserting a flip cap like flip cap 31 into opening 33*b* and positioning flip cap catching feature 34*b* so that it catches the bottom edge of a flip cap like flip cap 31 and articulating screw cap twisting tool 36 as depicted by arrow 35 in FIG. 8A. Note that the illustration of screw cap twisting tool 36 in FIG. 8B would have to rotate 180 degrees about its long axis 37 in order to correctly position it relative to flip cap 31 as illustrated in FIG. 8A.

Figure 9:
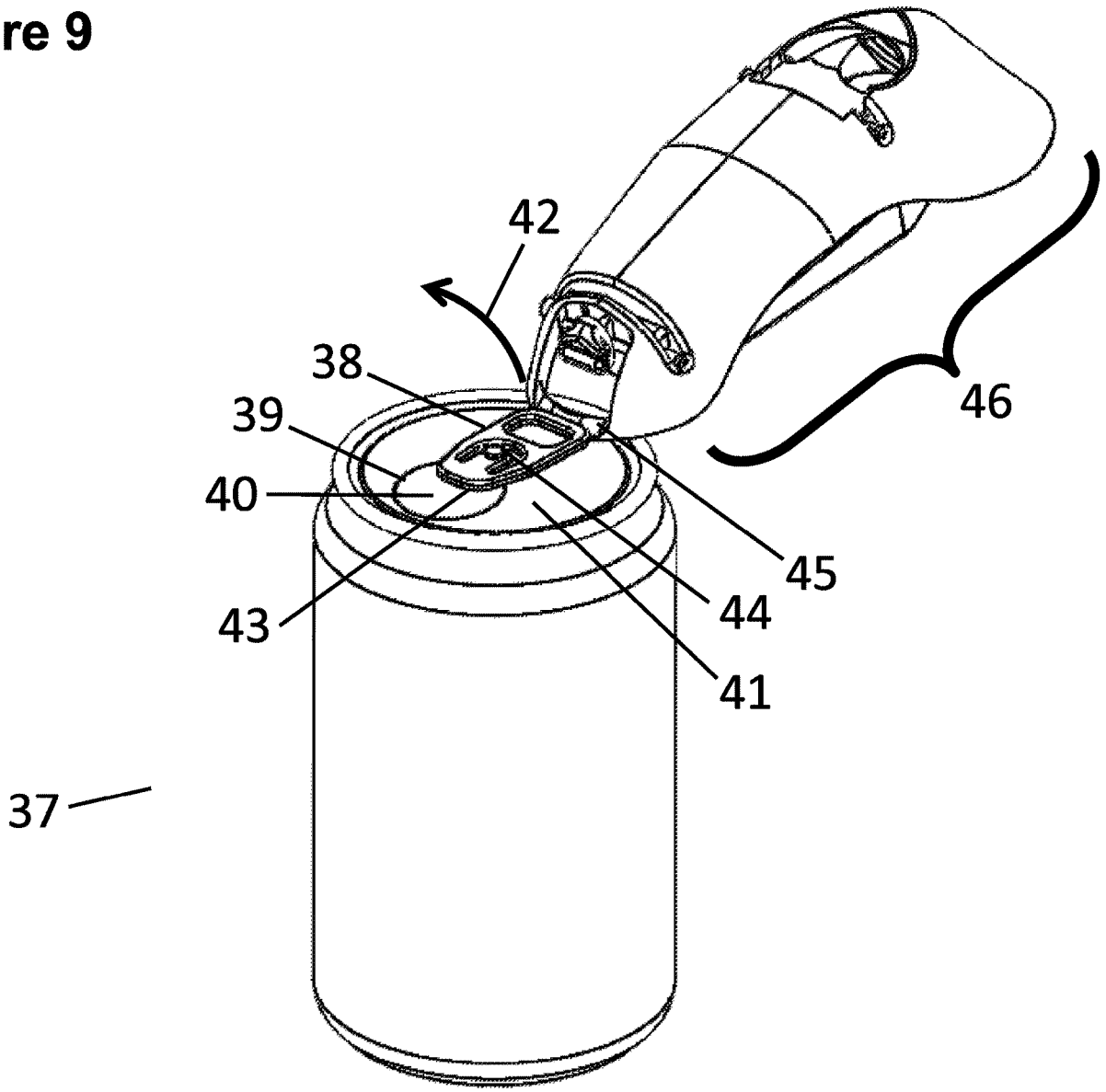
FIG. 9 shows a 3D illustration of a metal beverage container and a screw cap twisting tool that includes a pull tab catching feature for articulation of can-opening mechanisms on metal beverage containers that open by means of lifting a seal-breaking tab.

FIG. 9 shows a 3D illustration of a metal beverage container and a screw cap twisting tool that includes a pull tab catching feature for articulation of can-opening mechanisms on metal beverage containers that open by means of lifting a seal-breaking tab. Metal beverage container 37 has a seal-breaking tab 38 that opens metal beverage container 37 by breaking seal 39 to create an opening in can top 41 by forcing hole cover 40 to separate from can top 41. By lifting seal-breaking tab 38 as depicted by arrow 42, tab front 43 pushes down on hole cover 40 because seal-breaking tab 38 has an attachment point 44 near the center of can top 41. A pull tab catching feature 45 of screw cap twisting tool 46 provides a means for easily getting under seal-breaking tab 38 and provides leverage for easily lifting seal-breaking tab 38.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

Although the present invention has been described in terms of various embodiments, it is not intended that the invention be limited to these embodiments. Modification within the spirit of the invention will be apparent to those skilled in the art.

It is additionally noted and anticipated that although the device is shown in its most simple form, various components and aspects of the device may be differently shaped or modified when forming the invention herein. As such those skilled in the art will appreciate the descriptions and depictions set forth in this disclosure or merely meant to portray examples of preferred modes within the overall scope and intent of the invention and are not to be considered limiting in any manner. While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the scope of the invention.

What is claimed is:

1. A screw cap twisting tool comprising:

A. A stationary member comprising,
  i. A cap interfacing feature,
  ii. One or more gripping surfaces within the cap interfacing feature,
  iii. A hand interfacing feature with a shape that fits comfortably within the human hand,
  iv. A hand interfacing feature that has a radius that is greater than the screw cap with which it interfaces so as to provide greater leverage for twisting a screw cap, B. A pivoting member comprising,
  i. A cap interfacing feature,
  ii. One or more gripping surfaces within the cap interfacing feature,
  iii. A pivot accommodating feature that is,
    a. Positioned for high leverage,
    b. Oriented such that pushing a screw cap against the pivoting member articulates the pivoting member,
    c. Oriented such that articulating the pivoting member changes the distance between the stationary member gripping surface and the pivoting member gripping surface, C. A position retaining method for holding the pivoting member in its most open position before screw cap insertion.

2. A screw cap twisting tool of claim 1 wherein the cap interfacing feature of the pivoting member has two or more cap clamping tiers positioned at different distances from the pivoting axis so as to accommodate a wider range of cap diameters.

3. A screw cap twisting tool of claim 1 wherein the tool includes a flip cap catching feature for removal of caps that are press fit onto a beverage container such that cap removal requires prying rather than twisting.

4. A screw cap twisting tool of claim 1 wherein the tool includes a pull tab catching feature for articulation of can-opening mechanisms on metal beverage containers that open by means of lifting a seal-breaking tab.

5. A screw cap twisting tool of claim 1 wherein the tool includes both a flip cap catching feature for removal of caps that are press fit onto a beverage container such that cap removal requires prying rather than twisting and a pull tab catching feature for articulation of can-opening mechanisms on metal beverage containers that open by means of lifting a seal-breaking tab.

6. A screw cap twisting tool of claim 2 wherein the tool includes a flip cap catching feature for removal of caps that are press fit onto a beverage container such that cap removal requires prying rather than twisting.

7. A screw cap twisting tool of claim 2 wherein the tool includes a pull tab catching feature for articulation of can-opening mechanisms on metal beverage containers that open by means of lifting a seal-breaking tab.

8. A screw cap twisting tool of claim 2 wherein the tool includes both a flip cap catching feature for removal of caps that are press fit onto a beverage container such that cap removal requires prying rather than twisting and a pull tab catching feature for articulation of can-opening mechanisms on metal beverage containers that open by means of lifting a seal-breaking tab.

* * * * *